US006994214B2

(12) United States Patent
Yang

(10) Patent No.: US 6,994,214 B2
(45) Date of Patent: Feb. 7, 2006

(54) ACCESSORIES DISPLAY BOX

(75) Inventor: Qinghao Yang, New Providence (BS)

(73) Assignee: Global Industries Holdings Ltd., New Providence (BS)

( * ) Notice: Subject to any disclaimer, the term of this patent is extended or adjusted under 35 U.S.C. 154(b) by 63 days.

(21) Appl. No.: 10/687,395

(22) Filed: Oct. 15, 2003

(65) Prior Publication Data

US 2005/0023167 A1 Feb. 3, 2005

(30) Foreign Application Priority Data

Jul. 30, 2003 (TW) ..... 92213634 U

(51) Int. Cl.
*B65D 85/20* (2006.01)

(52) U.S. Cl. ..... 206/379; 206/373; 206/1.5

(58) Field of Classification Search ..... 206/1.5, 206/372, 373, 379, 349; 220/324, 326
See application file for complete search history.

(56) References Cited

U.S. PATENT DOCUMENTS

| | | | | |
|---|---|---|---|---|
| 4,011,940 | A * | 3/1977 | Neal et al. | 206/1.5 |
| 4,658,955 | A * | 4/1987 | Eichner | 206/307 |
| 5,676,254 | A * | 10/1997 | Cheng et al. | 206/751 |
| 6,415,923 | B1 * | 7/2002 | Chen | 206/379 |
| 6,547,074 | B1 * | 4/2003 | Chen | 206/379 |
| 6,547,077 | B1 * | 4/2003 | Budert | 206/754 |
| 2002/0117507 | A1 * | 8/2002 | Doerfler et al. | 220/835 |
| 2004/0084341 | A1 * | 5/2004 | Amtenbrink | 206/372 |
| 2004/0195128 | A1 * | 10/2004 | Chen | 206/349 |
| 2004/0200749 | A1 * | 10/2004 | Wang | 206/373 |

* cited by examiner

*Primary Examiner*—David T. Fidei
(74) *Attorney, Agent, or Firm*—Levenfeld Pearlstein; Leon I. Edelson; William C. Clarke

(57) ABSTRACT

An accessories display box is constructed to include a box body, a cover, and fastening devices adapted to fixedly secure the cover to the box body in the closed status, each fastening device having a male fastening member provided at the cover and a female fastening member provided at the box body and adapted to receive the male fastening member, the male fastening member being detachable from the female fastening member when inserted into the female fastening member.

14 Claims, 5 Drawing Sheets

ACCESSORIES DISPLAY BOX

BACKGROUND OF THE INVENTION

1. Field of the Invention

The present invention relates to an accessories display box for storing and showing tool accessories and, more particularly, to such an accessories display box that has fastening devices that fixedly secure the cover in the closed status to keep the display items in tact.

2. Description of the Related Art

Various accessories display boxes have been disclosed for use to keep and show tool accessories, and have appeared on the market. These accessories display boxes commonly have compartments for accommodating different tool accessories, and positioning means for keeping storage items in place. During exhibition, consumers may open the covers of the displayed accessories display boxes and pick up the storage items for visual inspection. Because the covers of conventional accessories display boxes can easily be opened, the display items may fall out of the accessories display boxes and scattered all over the surroundings. In order to prohibit consumers from opening the covers of accessories display boxes, adhesive tapes may be used to seal the covers. However, adhesive tapes can easily be broken, or detached from the accessories display boxes. Further, for holding a tool handle, an accessories display box must be made having a certain height, i.e., the compartment for tool handle must be deep enough to hold the tool handle firmly in place. However, it is difficult to pick up the tool handle from the deep too handle compartment. If the reduce the depth of the tool handle compartment, the tool handle may fall out of the tool handle compartment easily.

SUMMARY OF THE INVENTION

The present invention has been accomplished under the circumstances in view. It is the main object of the present invention to provide an accessories display box, which has fastening devices that fixedly secure the cover in the closed status to keep the display items in tact. It is another object of the present invention to provide an accessories display box, which has means to accommodate a tool handle for display without increasing the vertical height of the accessories display box, for enabling the consumers to touch the displayed tool handle with the hands when viewing the displayed tool handle.

To achieve these and other objects of the present invention, the accessories display box comprises a box body defining a plurality of compartments adapted to accommodate tool accessories, a cover adapted to cover the box body, and at least one fastening device adapted to fixedly secure the cover to the boxy body. Each fastening device comprises a female fastening member fixedly provided at the box body, and a male fastening member fixedly provided at the cover and adapted to engage the female fastening member. The female fastening member comprises a through hole, and a plurality of crevices radially extended around the through hole and longitudinally extended along the axial length of the through hole. The male fastening member has a conical head insertable through the through hole. The conical head has a bottom edge, which stops the conical head from backward movement after insertion of the conical head through the through hole. The box body further comprises a recessed tool handle seat extended through the compartments and adapted to accommodate a tool handle. The cover has a handle hole disposed corresponding to the tool handle seat and adapted to receive a part of the tool handle being rested in the tool handle seat.

DETAILED DESCRIPTION OF THE PREFERRED EMBODIMENT

Figure 1:
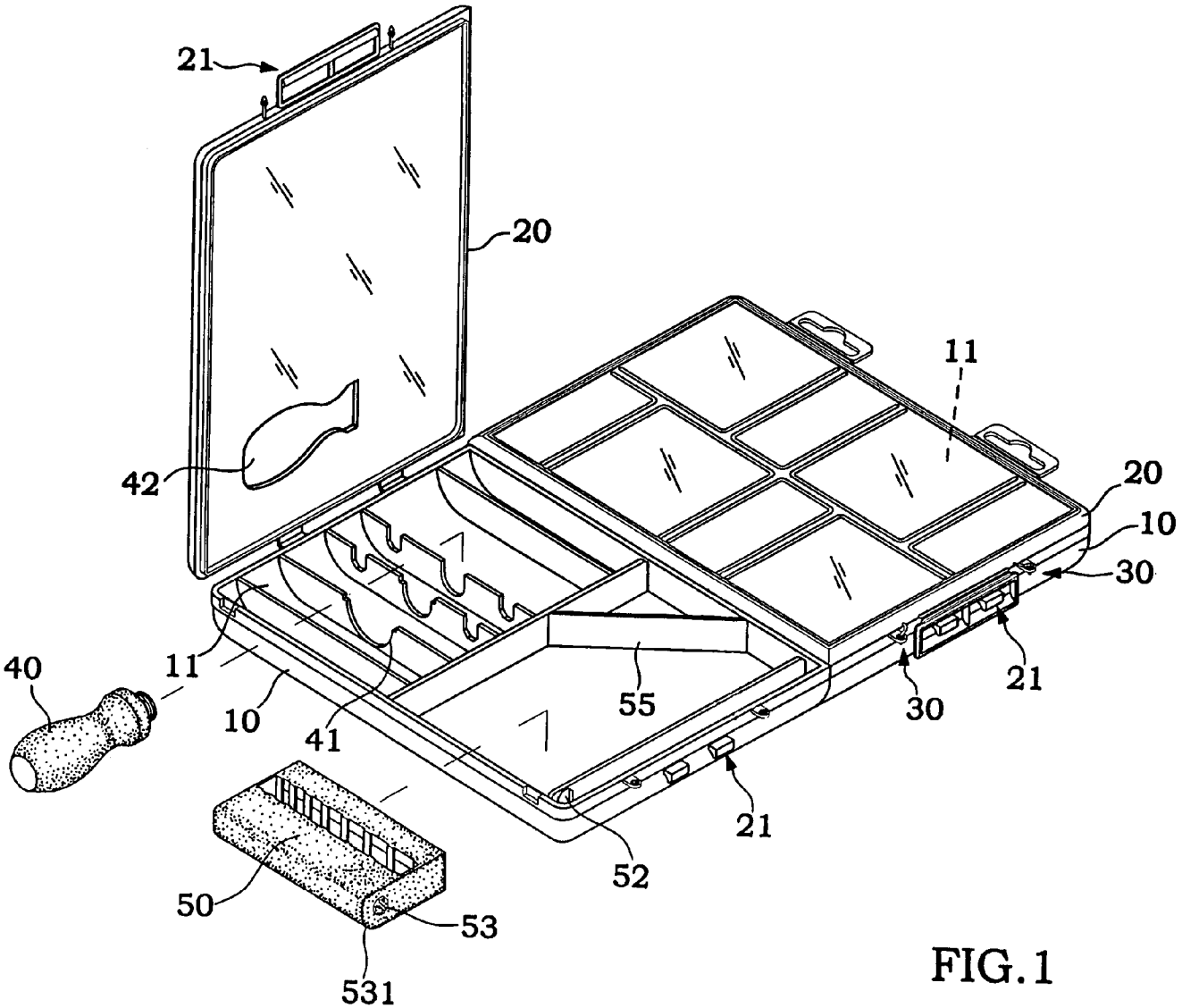
FIG. 1 is an exploded view of the preferred embodiment of the present invention.

Referring to FIG. 1, two accessories display boxes are shown abutted against each other, each accessories display box comprised of a box body 10, a cover 20 hinged to one side of the box body 10, and a lock 21 adapted to lock the cover 20 to the box body 10. The box body 10 has a plurality of compartments 11 adapted to accommodate tool accessories. The box body 10 and the cover 20 are respectively molded from transparent plastics so that the storage items (tool accessories) can be seen from the outside of the respective accessories display box.

Figures 2A, 2B, 2C:
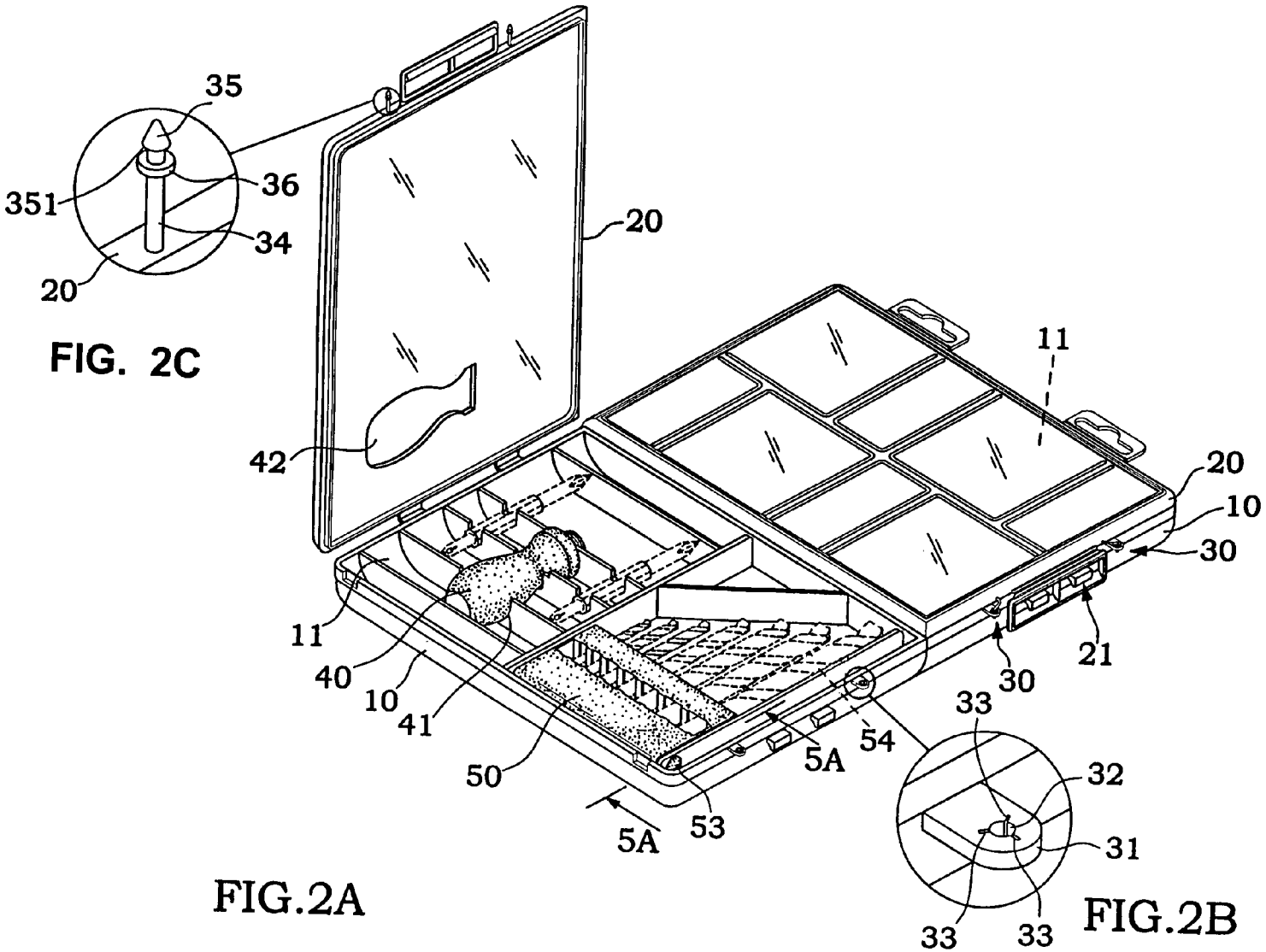
FIG. 2A is an assembly view of FIG. 1.
FIG. 2B is an enlarged view of a part of FIG. 2A showing the structure of the female fastening member.
FIG. 2C is an enlarged view of a part of FIG. 2A showing the structure of the male fastening member.

Referring to FIGS. 2A~2C and FIG. 1 again, each accessories display box 20 further comprises a plurality of fastening devices 30 adapted to fixedly secure the free end of the cover 20 to the box body 10. Each fastening device 30 comprises a female fastening member 31 provided at the box body 10, and a male fastening member 34 provided at the free end of the cover 20 and connectable to the female fastening member 31. The female fastening member 31 has a through hole 32 extended through the top and bottom sides thereof, and a plurality of crevices 33 radially extended from the through hole 32 and cut through the top and bottom sides of the female fastening member 31. Because of the presence of the crevices 33, the through hole 32 is slightly radially expansible. The male fastening member 34 is a rod member extended from one peripheral side of the cover 20, having a conical head 35, a collar 36 extended around the periphery and spaced from the bottom edge 351 of the conical head 35 at a distance approximately equal to the depth of the through hole 32. The diameter of the bottom edge 351 of the conical head 35 is slightly greater than the diameter of the through hole 32.

Figures 3A, 3B:
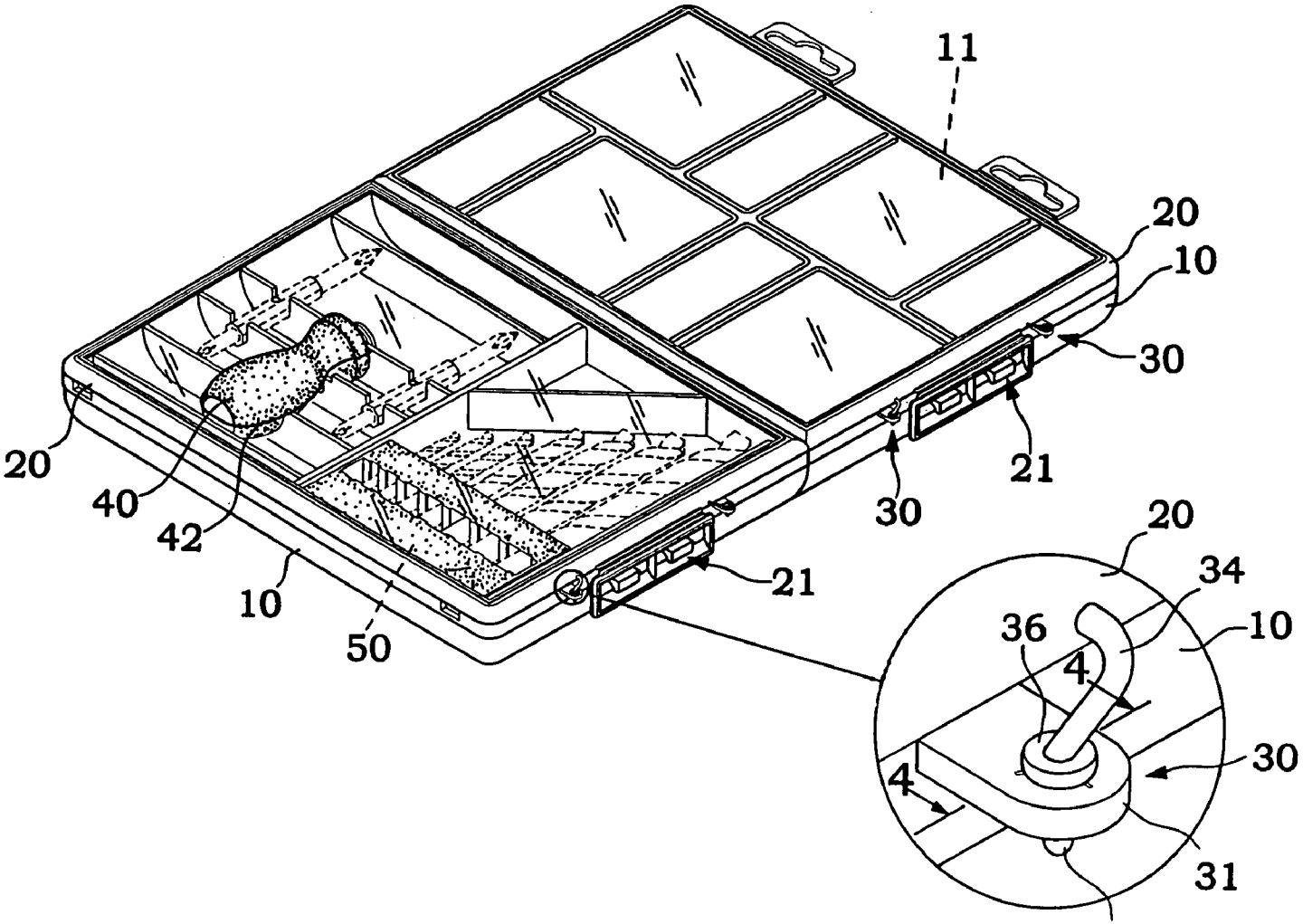
FIG. 3A is similar to FIG. 2A but showing the cover closed.
FIG. 3B is an enlarged view of a part of FIG. 3A showing the male fastening member fastened to the female fastening member.
Figure 4:
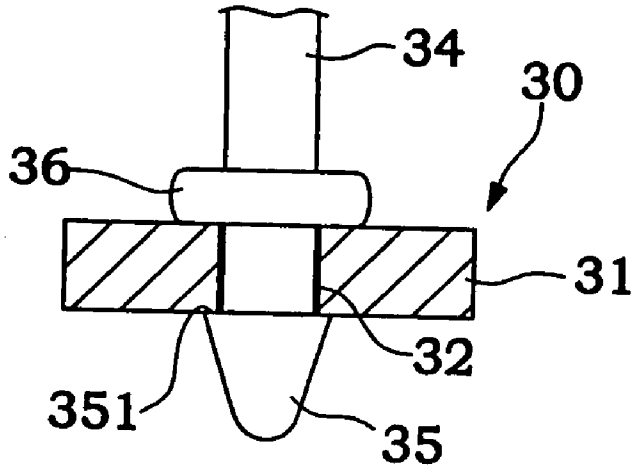
FIG. 4 is a sectional view in an enlarged scale taken along line 4—4 of FIG. 3B.

Referring to FIGS. 3A, 3B, and 4, when closed the cover 20 at the first time, the male fastening member 34 of each fastening device 30 is fastened to the respective female fastening member 31 to fixedly secure the cover 20 to the box body 10 in the close position. By means of the conical head 35, the male fastening member 34 can easily be inserted into the through hole 32 of the respective female fastening member 31. After insertion of the male fastening member 34 into the through hole 32 of the respective female fastening member 31, the bottom edge 351 of the conical head 35 and the collar 36 are respectively stopped at the top and bottom sides of the female fastening member 31 outside the through hole 32, and therefore the male fastening member 34 and the female fastening member 31 are fixedly fastened together, and cannot be separated from each other unless breaking the male fastening member 34 from the cover 20.

Referring to FIG. 3A and FIGS. 1 and 2A again, each accessories display box further comprises a tool handle positioning structure. The tool handle positioning structure comprises a recessed handle seat 41 disposed in the compartments 11 of the box body 10 and adapted to accommodate a tool handle 40, and a handle hole 42 formed at the cover 20 corresponding to the recessed portions 41 and adapted to receive a part of the tool handle 40 and to hold down the tool handle 40 in the recessed handle seat 41. When the cover 20 closed and fixedly fastened to the box body 10, the cover 20 holds down the tool handle 40 in the recessed handle seat 41, preventing displacement of the tool handle 40.

Figure 5A:
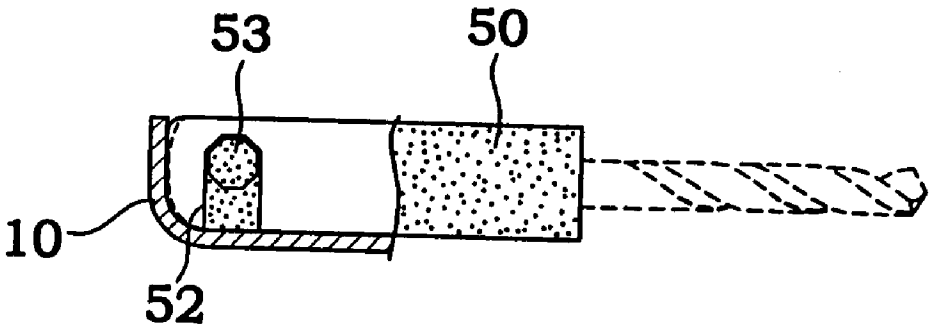
FIG. 5A is a sectional view in an enlarged scale taken along line 5A—5A of FIG. 2A.
Figure 5C:
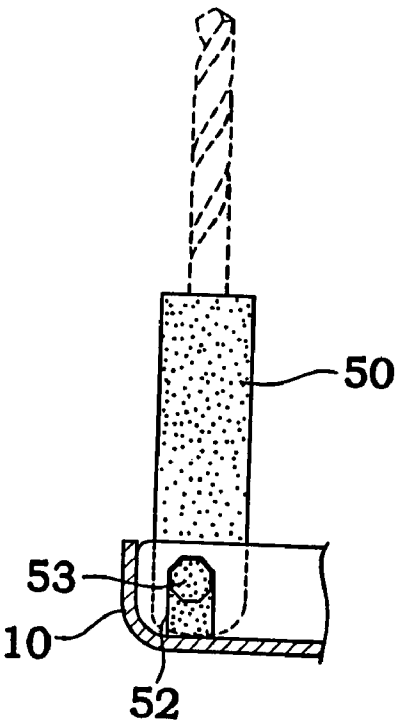
FIG. 5C is similar to FIG. 5B but showing the tool bit receptacle turned to vertical.
Figure 5B:
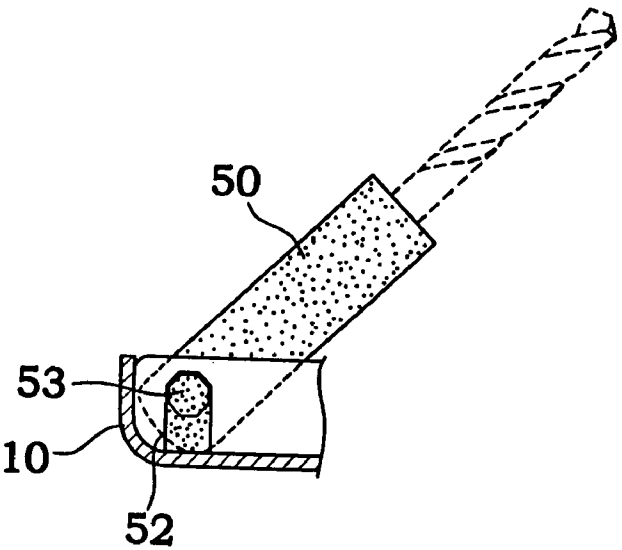
FIG. 5B is similar to FIG. 5A but showing the tool bit receptacle lifted from the box body.

Referring to FIGS. 5A~5C and FIGS. 1 and 2A again, each accessories display box further comprises a tool bit receptacle 50 fastened to the box body 10 and adapted to hold a set of tool bits 54 that are arranged in proper order subject to their lengths. The tool bit receptacle 50 has two polygonal coupling blocks 53 disposed at two opposite lateral sides adjacent to the bottom side 531 and respectively coupled to respective polygonal coupling holes 52 in the box body 10. Further, the bottom side 531 of the tool bit receptacle 50 is smoothly arched so that the tool bit receptacle 50 can be turned about the axis passing through the coupling holes 52 and positioned in one of a series of angular positions relative to the box body 10. Because the box body 10 is molded from plastics, the polygonal coupling blocks 53 can be turned with the tool bit receptacle 50 relative to the polygonal coupling holes 52 by force, and then quickly positioned in the desired angular position after release of external force. Further, an oblique stop wall 55 is provided inside the box body 10, and adapted to stop the storage tool bits 54 in the tool bit receptacle 50.

A prototype of accessories display box has been constructed with the features of FIGS. 1~5. The accessories display box functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An accessories display box comprising a box body, molded from transparent plastic, said box body defining a plurality of compartments adapted to accommodate tool accessories, a cover, molded from transparent plastic, adapted to cover said box body, and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole, once the male fastening member and the female fastening member are fixedly fastened together they cannot be separated from each other unless the male fastening member is broken from the cover.

2. The accessories display box as claimed in claim 1, wherein said box body comprises a recessed tool handle seat extended through said compartments and adapted to accommodate a tool handle; said cover comprises a handle hole disposed corresponding to said tool handle seat and adapted to receive a part of the tool handle being rested in said tool handle seat.

3. The accessories display box as claimed in claim 1, wherein said male fastening member further comprises a collar extended around the periphery thereof and spaced from said conical head at a distance approximately equal to the axial length of said through hole, said collar having a diameter greater than the diameter of said through hole.

4. The accessories display box as claimed in claim 1, further comprising a tool bit receptacle fastened pivotally with an inside wall of said box body and turnable in and out of said box body and adapted to receive a set of tool bits.

5. The accessories display box as claimed in claim 4, wherein said box body further comprises an oblique stop wall adapted to stop storage tool bits in said tool bit receptacle when said tool bit receptacle set inside said box body.

6. An accessories display box comprising a box body, molded from transparent plastic, said box body defining a plurality of compartments adapted to accommodate tool accessories, a cover, molded from transparent plastic, adapted to cover said box body, and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole; said cover having a tool handle hole adapted to hold down a tool handle in said box body, once the male fastening member and the female fastening member are fastened together they cannot be separated from each other unless the male fastening member is broken from the cover.

7. The accessories display box as claimed in claim 6, wherein said box body comprises a recessed tool handle seat formed in said compartments corresponding to said tool handle hole for accommodating a tool handle.

8. The accessories display box as claimed in claim 6, wherein said male fastening member further comprises a collar extended around the periphery thereof and spaced from said conical head at a distance approximately equal to the axial length of said through hole, said collar having a diameter greater than the diameter of said through hole.

9. The accessories display box as claimed in claim 6, further comprising a tool bit receptacle fastened pivotally with an inside wall of said box body and turnable in and out of said box body and adapted to receive a set of tool bits.

10. An accessories display box comprising a box body, molded from transparent plastic, said box body defining a plurality of compartments adapted to accommodate tool accessories, a cover, molded from transparent plastic, adapted to cover said box body further comprising a tool bit receptacle fastened pivotally with an inside wall of said box body and turnable in and out of said box body and adapted to receive tool bits, said box body comprising two polygonal coupling holes aligned at two sides, said tool bit receptacle comprising two polygonal coupling blocks disposed at two sides and respectively coupled to said polygonal coupling holes and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole, once the male fastening member and the female fastening member are fixedly fastened together they cannot be separated from each other unless the male fastening member is broken from the cover.

11. An accessories display box comprising a box body, molded from transparent plastic, said box body defining a plurality of compartments adapted to accommodate tool accessories, further comprising a tool bit receptacle fastened pivotally with an inside wall of said box body and turnable in and out of said box body and adapted to receive a set of tool bits, further comprising an oblique stop wall adapted to stop storage tool bits in said tool bit receptacle when the tool bit receptacle is set inside the box body and wherein the tool bit receptacle has a smooth arched bottom side and polygonal coupling blocks are disposed adjacent to the smoothly arched bottom side, a cover, molded from transparent plastic, adapted to cover said box body, and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole, once the male fastening member and the female fastening member are fixedly fastened together they cannot be separated from each other unless the male fastening member is broken from the cover.

12. An accessories display box comprising a box body, molded from transparent plastic, said box body defining a plurality of compartments adapted to accommodate tool accessories, a cover, molded from transparent plastic, adapted to cover said box body, the box body further comprising an oblique stop wall adapted to stop storage tool bits in said tool bit receptacle when the tool bit receptacle is set inside said box body, and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole, the male fastening member further comprising a collar extended around the periphery thereof, said cover having a tool handle hole adapted to hold down a tool handle in said box body, once the male fastening member and the female fastening member are fixedly fastened together they cannot be separated from each other unless the male fastening member is broken from the cover.

13. An accessories display box comprising a box body, molded from transparent plastic, said box body defining a plurality of compartments adapted to accommodate tool accessories comprising two polygonal coupling holes aligned at two sides; said tool bit receptacle comprising two polygonal coupling blocks disposed at two sides and respectively coupled to said polygonal coupling holes, a cover, molded from transparent plastic, adapted to cover said box body, and at least one fastening device adapted to fixedly secure and lock said cover to said box body, wherein each said fastening device comprises a female fastening member fixedly provided at said box body, said female fastening member comprising a through hole and a plurality of crevices radially extended around said through hole and longitudinally extended along the axial length of said through hole, and a male fastening member fixedly provided at said cover and adapted to engage said female fastening member, said male fastening member having a conical head insertable through said through hole, said conical head having a bottom edge, which stops said conical head from backward movement after insertion of said conical head through said through hole; the male fastening member further comprising a collar extended around the periphery thereof, said cover having a tool handle hole adapted to hold down a tool handle in said box body, once the male fastening member and the female fastening member are fixedly fastened together they cannot be separated from each other unless the male fastening member is broken from the cover.

14. The accessories display box as claimed in claim 13, wherein said tool bit receptacle has a smoothly arched bottom side, and said polygonal coupling blocks are disposed adjacent to said smoothly arched bottom side.

* * * * *